US011517910B2

(12) United States Patent
Kurochka

(10) Patent No.: US 11,517,910 B2
(45) Date of Patent: Dec. 6, 2022

(54) MATERIAL BREAKING DEVICE

(71) Applicant: NANO COAL, SIA, Riga (LV)

(72) Inventor: Aleksandr Kurochka, Riga (LV)

( * ) Notice: Subject to any disclaimer, the term of this patent is extended or adjusted under 35 U.S.C. 154(b) by 136 days.

(21) Appl. No.: 16/644,344

(22) PCT Filed: Sep. 4, 2017

(86) PCT No.: PCT/IB2017/055300
§ 371 (c)(1),
(2) Date: Mar. 4, 2020

(87) PCT Pub. No.: WO2019/043439
PCT Pub. Date: Mar. 7, 2019

(65) Prior Publication Data

US 2021/0060572 A1 Mar. 4, 2021

(51) Int. Cl.
*B02C 17/00* (2006.01)
*B02C 17/06* (2006.01)
*B02C 19/18* (2006.01)

(52) U.S. Cl.
CPC ..... *B02C 17/005* (2013.01); *B02C 17/06* (2013.01)

(58) Field of Classification Search
CPC ..... B02C 17/005; B02C 17/06; B02C 19/18
See application file for complete search history.

(56) References Cited

U.S. PATENT DOCUMENTS 3,398,902 A * 8/1968 Petrovich ..... B01F 13/0809 241/170
3,787,034 A * 1/1974 Shvartsman ..... B01F 13/08 366/228
3,987,967 A * 10/1976 Kuznetsov ..... B01F 13/0809 241/1
4,632,315 A * 12/1986 Watanabe ..... B01J 8/42 241/26
5,022,592 A * 6/1991 Zakheim ..... B02C 17/163 241/172
5,178,338 A * 1/1993 Zakheim ..... B02C 17/005 241/172

FOREIGN PATENT DOCUMENTS

DE 888641 C * 9/1953 ..... B02C 17/005

OTHER PUBLICATIONS

English translate (DE888641C), retrieved date Jan. 13, 2022.*

* cited by examiner

*Primary Examiner* — Jessica Cahill
*Assistant Examiner* — Mohammed S. Alawadi
(74) *Attorney, Agent, or Firm* — Patshegen IP; Moshe Pinchas

(57) ABSTRACT

Invention relates to material breaking or milling devices for ultra-fine milling of materials. A material breaking device comprises a frame structure (1) with an upper bracket (1A) and a lower bracket (1B); a tubular housing (4) arranged between said brackets (1A, 1B). The tubular housing (4) is attached to said frame structure (1) in rotatable manner such that the tubular housing (4) rotates relative to the frame structure (1). The material breaking device further comprises at least one conical distributor (5) arranged in the tubular housing (4) and at least one outlet cone (7) arranged in the tubular housing (4) downstream from the conical distributor (5). The device further comprises a permanent magnet unit (9) attached to the tubular housing (4) such that at least two permanent magnet units (9) are provided for each milling chamber (6, 8) for creating rotating magnetic field within the milling chambers (6, 8).

10 Claims, 9 Drawing Sheets

MATERIAL BREAKING DEVICE

FIELD OF THE INVENTION

Invention relates to material breaking or milling devices for ultra-fine milling of materials.

BACKGROUND OF THE INVENTION

Different types of material breaking or milling devices are know from the prior art for preparation of powder material or fine particle material.

European patent publication No. EP 1 669 137 discloses a material milling device with a mill chamber, an injector for the material to be milled, a manifold connected to the chamber at the exterior of a lid thereof, one or more atomizers for supply of pressurized air, and a cyclone connected to the manifold for taking down the back pressure of the mill chamber, wherein the atomizers are connected to the mill chamber casing at an angle with respect to a vertical axis and at an angle with respect to a cylindrical injector for supply of material and pressurized air.

Former soviet union patent publication No. SU 906613 discloses an apparatus for continuous milling and mixing of solid granular materials, comprising a cylindrical working chamber from a non-magnetic material magnetically working components as rotary stimulus material travel and three-phase power rotating electromagnetic field.

U.S. Pat. No. 5,022,592 discloses media mill having a magnetic circuit of magnetic impellers on a shaft, magnetized media, and a magnetisable outer shell which provides improved efficiency.

SUMMARY OF THE INVENTION

The aim of the invention is to design a material breaking device capable of ultra-fine particle milling with high milling performance and productivity.

The aim is reached by designing a material breaking device comprising vertical tubular housing, in which conical distributors are arranged, and a permanent magnet unit for creating rotatable magnetic field within the tubular housing facilitating grinding or milling of particles.

The material breaking device comprises a frame structure with at least two protrusions or brackets for support of other elements of the material breaking device. An upper brackets is positioned in an upper part of the material breaking device, but a lower bracket is positioned in a lower part of the material breaking device. The frame structure itself can be attached to any other element or surface in a plant for preparation of ultra-fine particles. The frame structure serves as a base or support element for the material breaking device. The frame structure further comprises an inlet tube fixedly attached to the upper protrusion or bracket and an outlet tube fixedly attached to the lower protrusion or bracket. Additionally a hopper is attached to the inlet tube for providing particles to be milled and a pressurized fluid. The pressurized fluid is necessary for providing a rate of flow of the particles through the material breaking device. The pressurized fluid may be a gas selected from the group of following gases: an air; inert gas; noble gas; oxygen; and nitrogen. In certain cases, a liquid nitrogen may be fed together with particles to be milled. If necessary, the fluid may be fed into the material breaking device already heated. In the same manner, particles to be milled may be fed into the material breaking device already heated.

The material breaking device further comprises a tubular housing that is arranged between said protrusions or brackets and attached to the inlet tube for receiving particles to be milled and the outlet tube for output of milled particles, wherein the tubular housing is attached to said tubes in a rotatable manner such that the tubular housing rotates relative to the frame structure. Therefore, the tubular housing with all elements attached thereto can rotate relative to said frame structure. The relative rotation can be accomplished by installation of bearings between the protrusions or brackets and the tubular housing. Any other design known by skilled person may be used for providing relative motion between the tubular housing and the tube. The material breaking device comprises a drive unit that is arranged for providing rotation of the tubular housing relative to the frame structure, the inlet tube and the outlet tube creating rotating magnetic field within the milling chambers, therefore providing improved milling performance. The drive unit may be electric, hydraulic or pneumatic motor engaged with the tubular housing through a gear transmission, belt transmission or any other transmission know to the person skilled in the art.

The tubular housing further comprises at least one first conical distributor arranged within thereof. The first conical distributor defines a first milling chamber. The first conical distributor further comprises recesses therearound allowing particles to pass along said first conical distributor. The recesses are positioned at the base of the conical distributor. Due to recesses, when particles pass through theses recesses, a rotational movement or even a chaotic movement of the particles is transferred to a linear movement. The particles arrive in the next milling chamber linear motion trajectory which is generally parallel to a central axis of the tubular housing. The following change of trajectory of particle improves the grinding performance. The first conical distributor defines a first milling chamber. The first conical distributor may be in the shape of concave cone for enhancing particle movement to its periphery and following movement through said recesses.

The tubular housing further comprises at least one outlet cone arranged in the tubular housing downstream from the conical distributor. The outlet cone comprises a through hole in centre thereof allowing particles to pass through said outlet cone and enter next milling chamber or exiting said tubular housing through the outlet tube. The outlet cone defines a second milling chamber. The second conical distributor may be in the shape of concave cone.

The conical distributor and the outlet cone define a pair of milling chambers, wherein the tubular housing comprises at least one pair of the conical distributor and the outlet cone, preferably from three to six pairs of the conical distributor and the outlet cone, more preferably five pairs of conical distributor and the outlet cone.

The tubular housing further comprises a permanent magnet unit for providing magnetic field within said milling chambers. The permanent magnet unit comprising a permanent magnet and the permanent magnet unit is attached to the tubular housing such that at least two permanent magnet units are provided for each milling chamber.

Moreover, at each milling chamber two permanent magnet units are positioned facing each other such that the permanent magnet of one permanent magnet unit faces another permanent magnet of another permanent magnet unit with the same magnetic pole. The permanent magnets of each permanent magnet unit are positioned so that each of theses magnets faces tubular housing with the same magnetic pole—altogether facing the tubular housing with the north pole or in another embodiment altogether facing the tubular housing with the south pole.

The permanent magnet unit further comprises a gap adjustment means to control a distance between the permanent magnet and the tubular housing such that magnetic field generated by the permanent magnet can be adjusted.

Moreover, the material breaking device is positioned vertically to facilitate the movement of the particles through said milling chamber by means of gravity.

The first milling chamber or/and the second milling chamber may contain milling particles made of magnetic material. These particles are fed into the milling chambers together with the material to be milled or are already positioned in each chamber. When in use, the magnetic material milling particles are set into the motion by the permanent magnet unit. This motion of magnetic material milling particles further facilitates break down of the material to be milled, which is fed into the milling chambers. The material to be milled is non-magnetic material. The milling particles may be in various shapes, for example, in a shape of needle, ball, cylinder, pyramid or cube. The necessary shape and amount of milling particles into the milling chamber is adjusted depending on a material to be milled and a necessary characteristics to be achieved for milled material.

A new material breaking device also needs a new method for breaking material. The method comprises the following main steps: feeding particles into the device and providing rotational movement of the tubular housing that creates magnetic field setting into a further motion or acceleration particles to be milled facilitating its breaking.

The particles to be milled are fed into a tubular housing through the inlet tube. The pressurized fluid, especially pressurised gas, may be also fed into the tubular housing. A rotation of the tubular housing is provided relative to a frame structure in result of which a rotational magnetic field is created within the tubular housing, especially within a first milling chamber and a second milling chamber in the tubular housing such that particles are set into a further motion or acceleration against an inner wall of the tubular housing, the conical distributor and the outlet cone that facilitates breaking of said particles. After particles have made through all milling chamber, they outflow the tubular housing through the outlet tube.

BRIEF DESCRIPTION OF THE DRAWINGS

These and other objects and advantages of the invention and a better understanding of the principles and details of the invention will be evident from the following description taken in connection with the following drawings in which.

DETAILED DESCRIPTION

Figure 1:
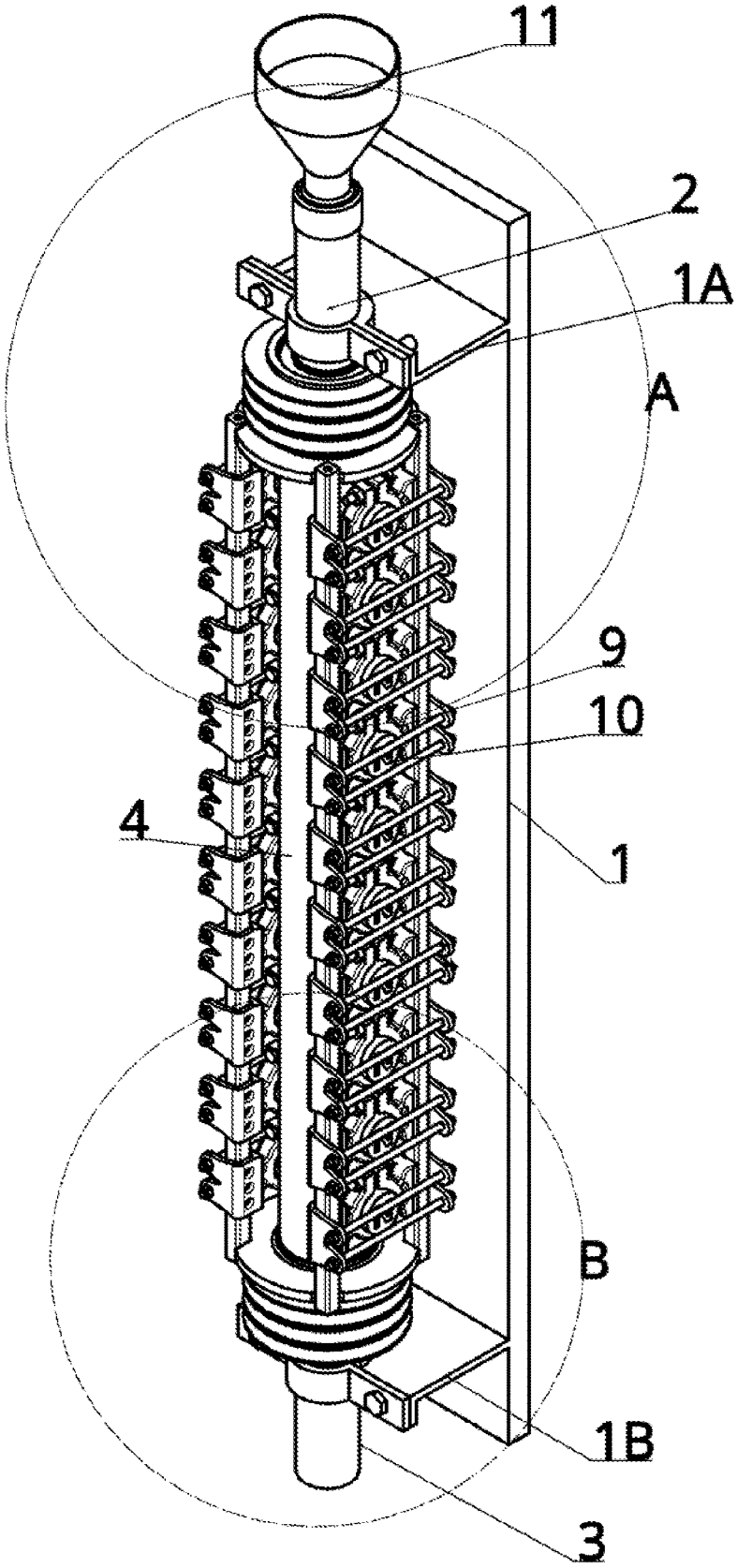
FIG. 1 illustrates a material breaking device.
Figure 2:
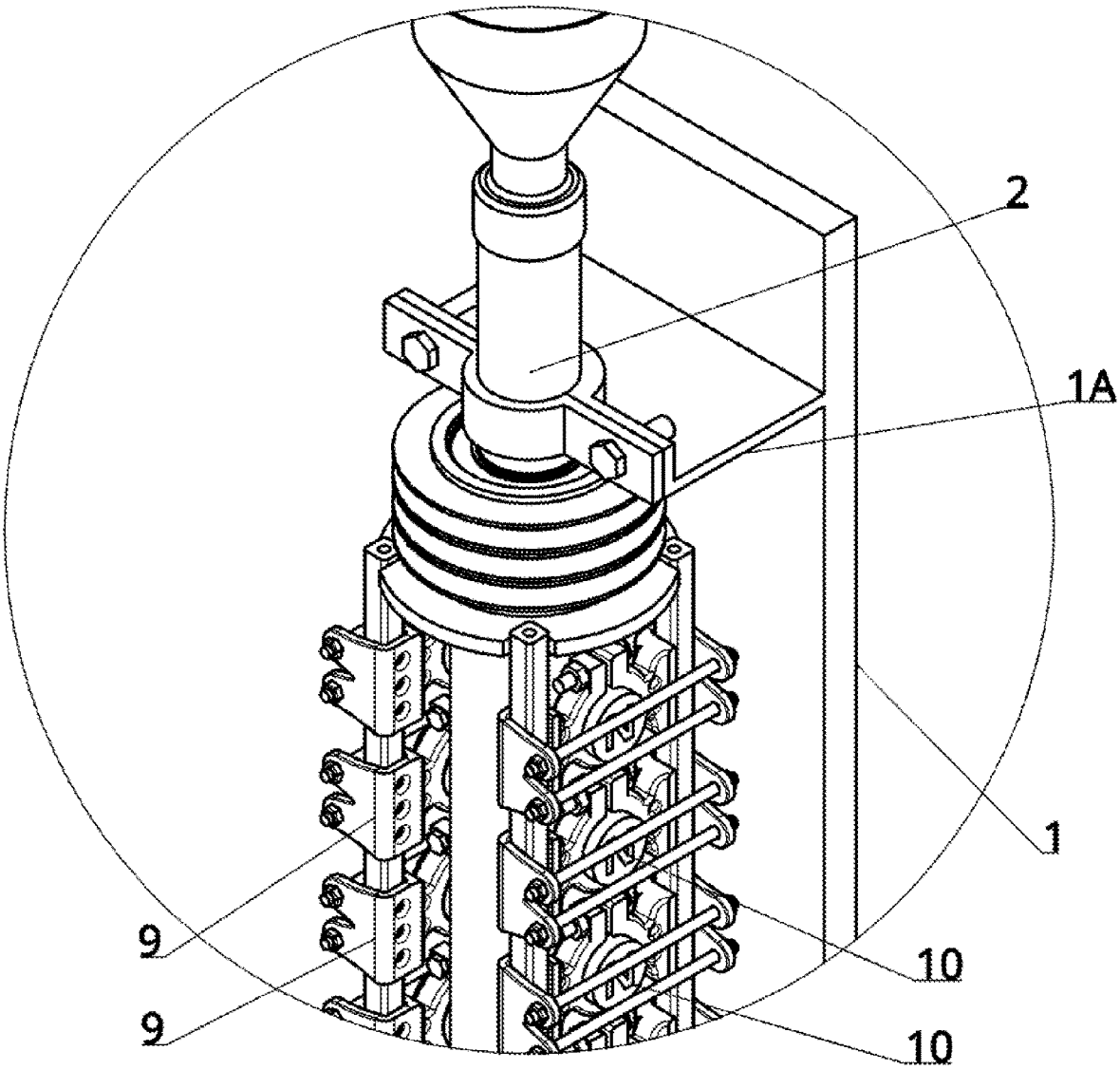
FIG. 2 illustrates an upper part of the material breaking device.
Figure 3:
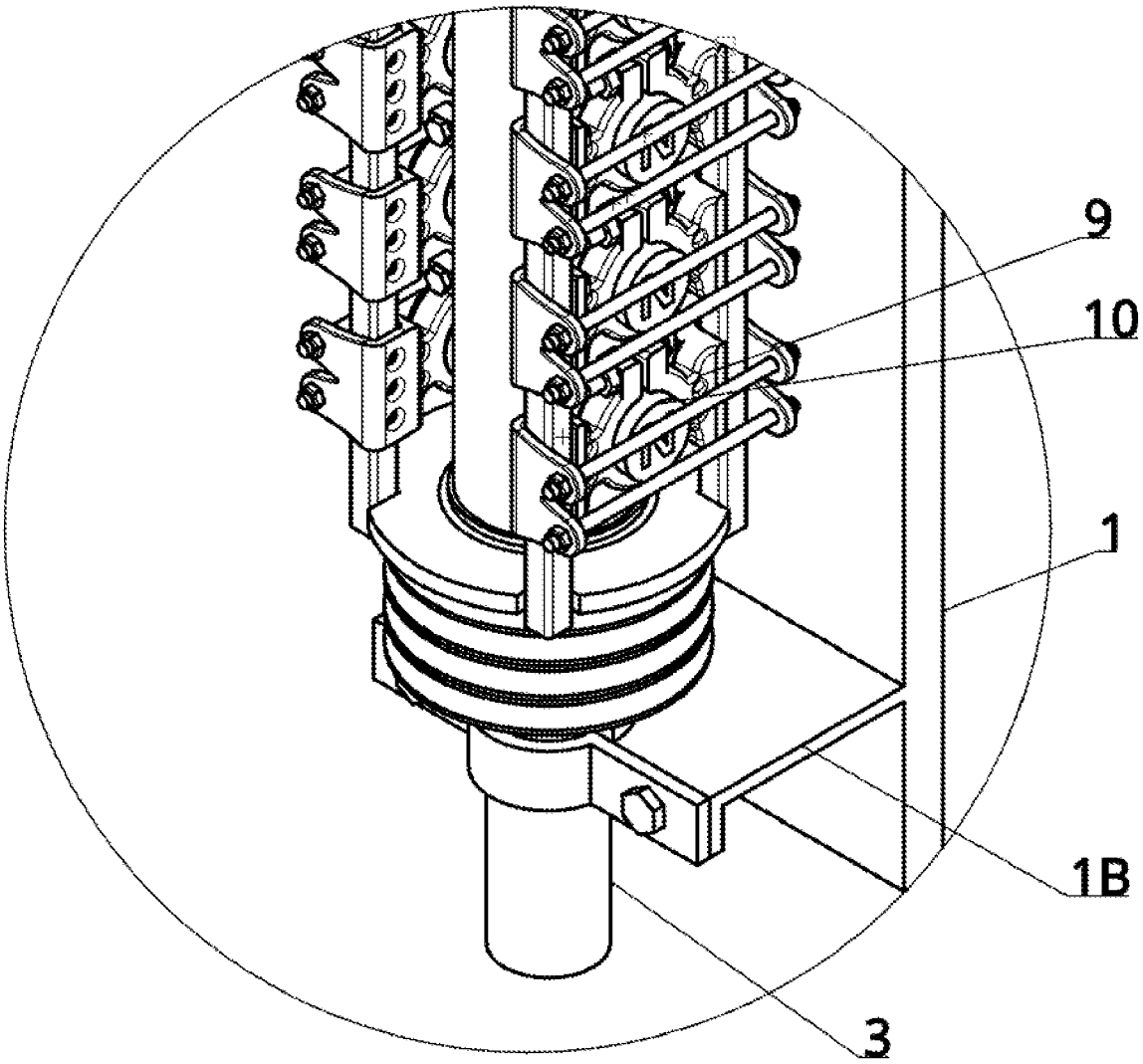
FIG. 3 illustrates a lower part of the material breaking device.

A material breaking device comprises a frame structure 1 with an upper bracket 1A and a lower bracket 1B for support of other elements of the material breaking device (FIGS. 1 to 4). Said elements are an inlet tube 2 fixedly attached to the upper bracket 1A and an outlet tube 3 fixedly attached to the lower bracket 1B.

The material breaking device further comprises a tubular housing 4 arranged between the upper bracket 1A and the lower bracket 1B. The tubular housing 4 is attached to the inlet tube 2 for receiving particles to be milled and to the outlet tube 3 for output of milled particles, wherein the tubular housing 4 is attached to said tubes 2 and 3 in a rotatable manner such that the tubular housing 4 can rotate relative to the frame structure. The inlet tube 2 further comprises a hopper 11 for ease of material feeding.

Figure 5:
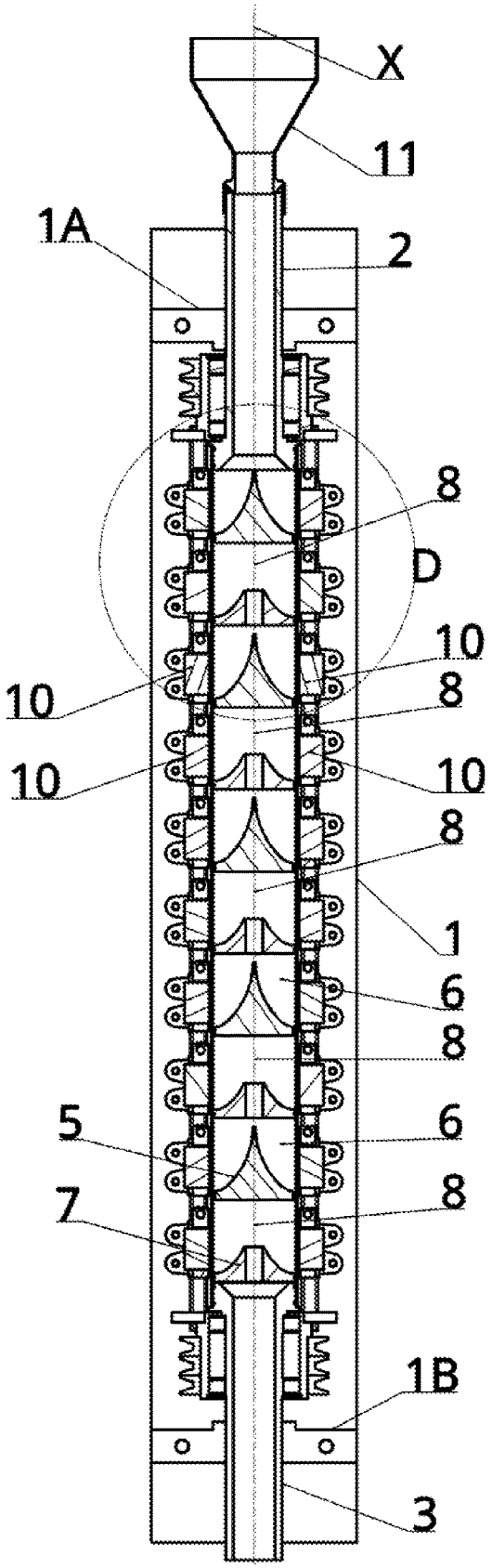
FIG. 5 illustrates a cross section of a material breaking device taken along a plane C-C of FIG. 4.
Figure 6:
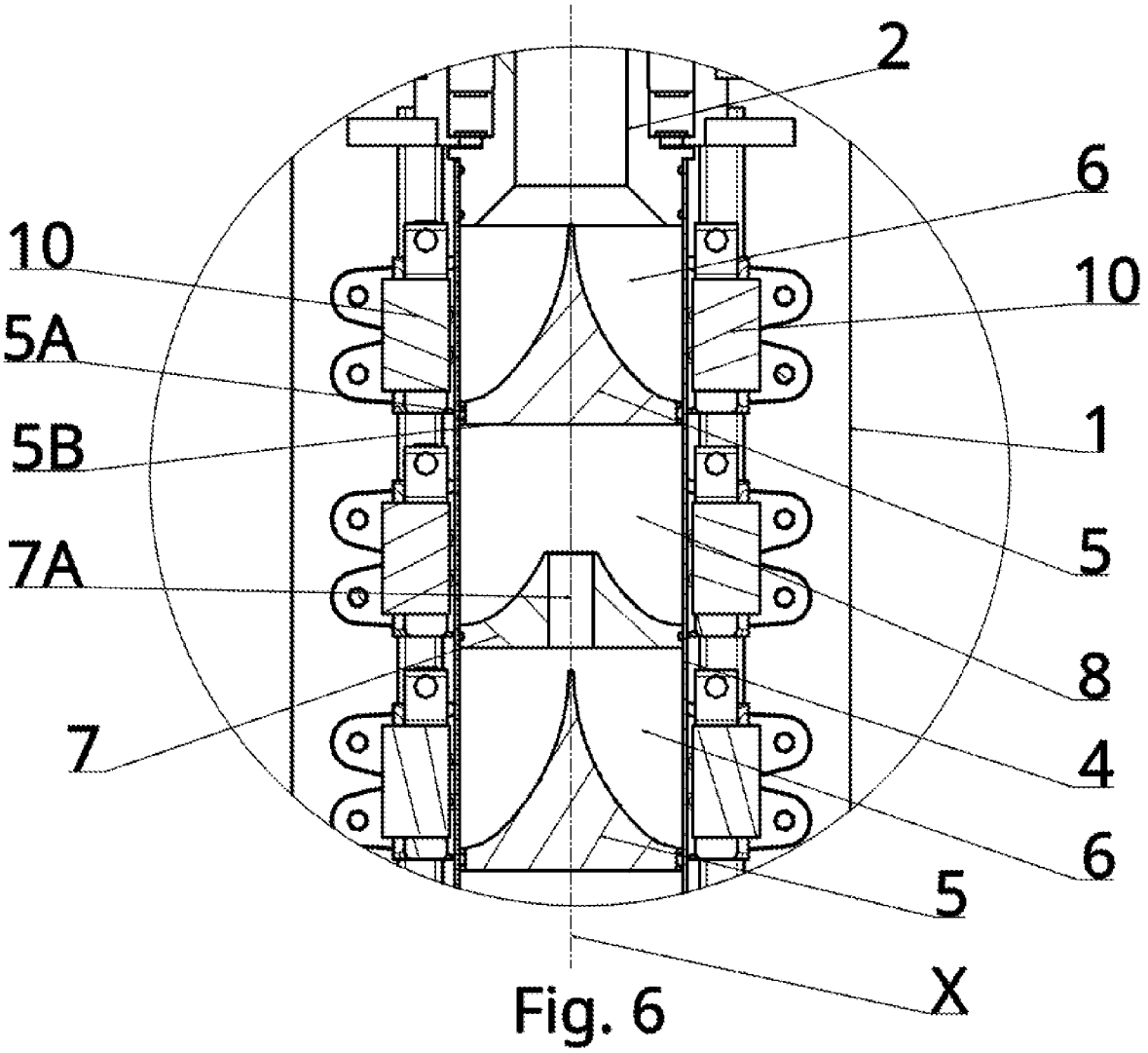
FIG. 6 illustrates a detailed view of the material breaking device taken in section D of FIG. 5.
Figure 7:
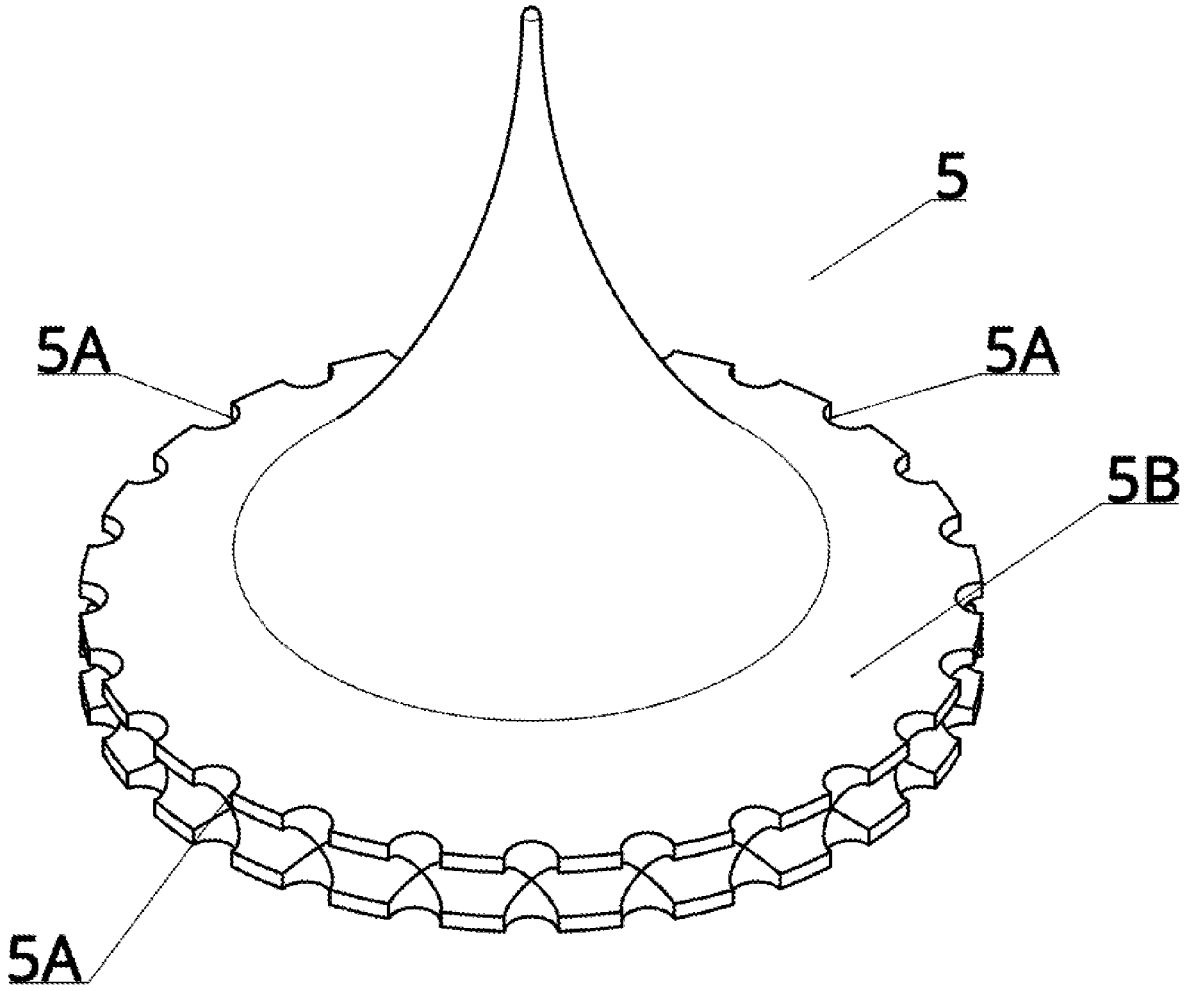
FIG. 7 illustrates a conical distributor 4 with recesses around perimeter of thereof.

The tubular housing further comprises at least one conical distributor 5 fixedly attached to the tubular housing 4 and comprising recesses 5A therearound allowing particles to pass along said conical distributor 5, wherein the conical distributor 5 defines a first milling chamber 6. The conical distributor 5 is in the shape of concave cone. The recesses 5A of the conical distributor 5 are arranged therearound at a base portion 5B of the conical distributor 5 creating a channels for particles movement from one milling chamber to another one (FIGS. 5, 6 and 7).

Figure 8:
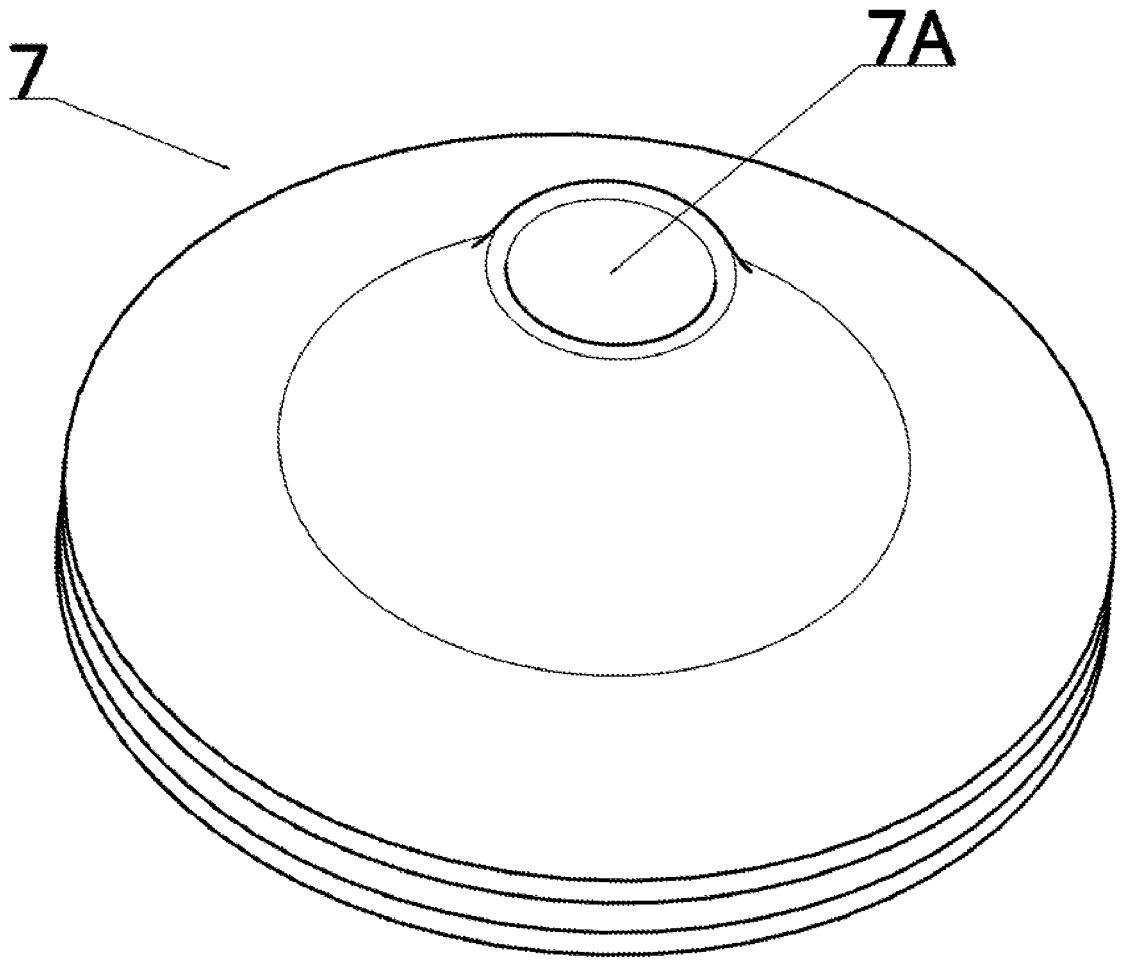
FIG. 8 illustrates an outlet cone 9 with a hole in the centre of thereof.
Figure 9:
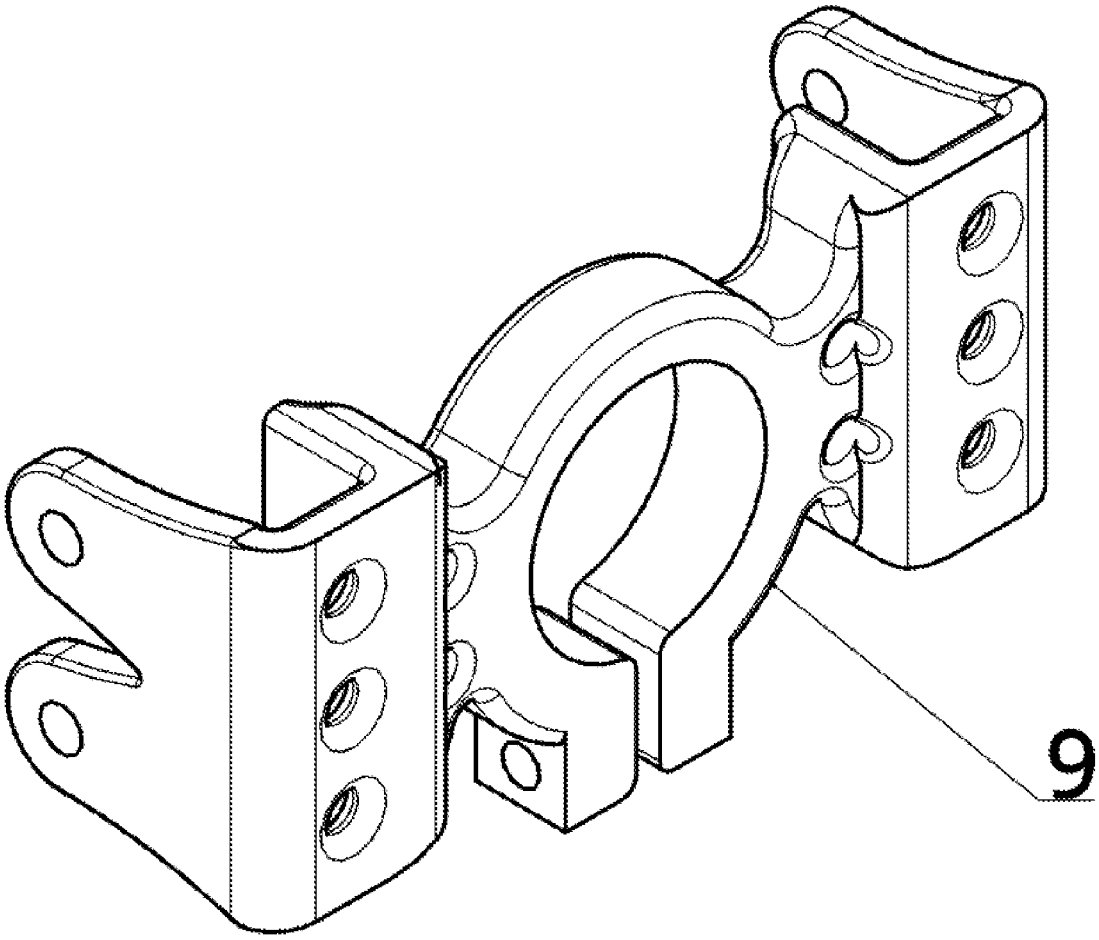
FIG. 9 illustrates a permanent magnet unit 7 without inserted permanent magnet 5.

The tubular housing 4 further comprises at least one outlet cone 7 also fixedly attached to tubular housing 4 downstream from the conical distributor 5 and comprising a through hole 7A allowing particles to pass through said outlet cone 7, wherein the outlet cone 7 defines a second milling chamber 8. The outlet cone 7 is in the shape of concave cone. The through hole 7A of the outlet cone 7 extends along the central axis of the outlet cone 7 (FIGS. 5, 6 and 8).

The material breaking device further comprises permanent magnet units 9 where each unit 9 comprises a permanent magnet 10 and the permanent magnet unit 9 is attached to the tubular housing 4 such that at least two permanent magnet units 9 are provided for each milling chamber 6, 8. Two permanent magnet units 9 are positioned at each milling chamber 6 and 8 facing each other such that the permanent magnet 1 of one permanent magnet unit 9 faces another permanent magnet 10 of another permanent magnet unit 9 with the same magnetic pole. (FIGS. 1 to 6 and 9). The rotational movement is provided by a drive unit. The unit provides rotation of the tubular housing 4 relative to the frame structure 1, the inlet tube 2 and the outlet tube 3 creating rotating magnetic field within the milling chambers 6 and 8.

The permanent magnet unit 9 further comprises a gap adjustment means to control a distance between the permanent magnet 10 and the tubular housing 4 such that magnetic field generated by the permanent magnet 10 can be adjusted.

Figure 4:
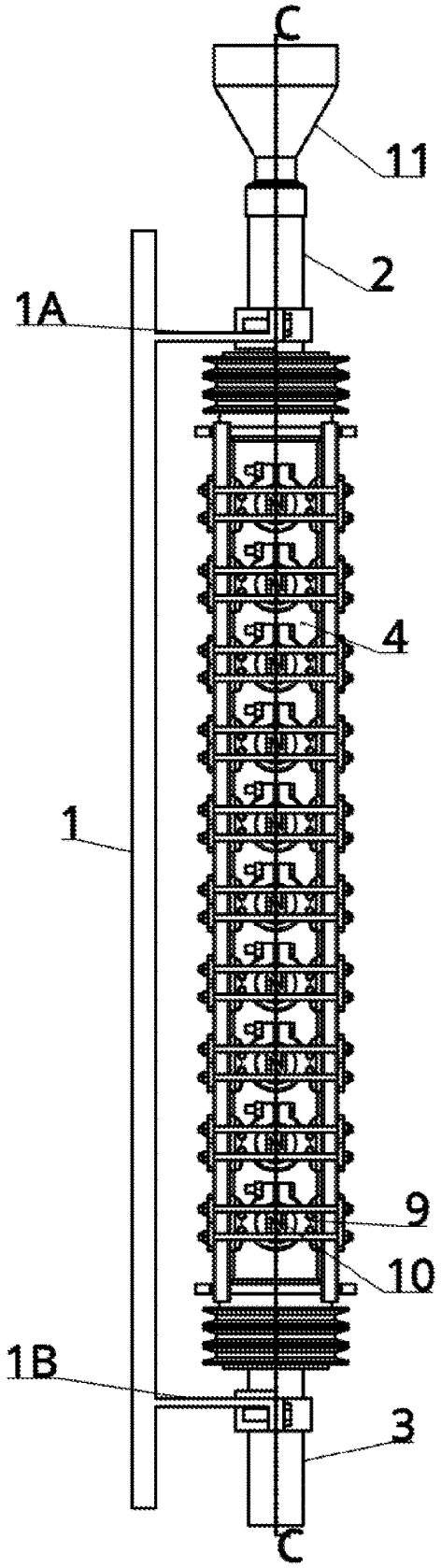
FIG. 4 illustrates the material breaking device is a side view.

FIGS. 1, 4 and especially FIG. 5 illustrate the material breaking device having five pairs of conical distributor 5 and the outlet cone 7.

References in the FIGS

1—a frame structure;
1A—an upper bracket;
1B—a lower bracket;

2—an inlet tube;
3—an outlet tube;
4—a tubular housing;
5—a conical distributor;
5A—a recess of the conical distributor 5;
5B—a base portion of the conical distributor 5;
6—a first milling chamber;
7—an outlet cone;
7A—a through hole of the outlet cone 7;
8—a second milling chamber;
9—a permanent magnet unit;
10—a permanent magnet;
11—a hopper;
X—a central axis of the tubular housing 4.

The invention claimed is:

1. A material breaking device comprising:

a frame structure (1) with an upper bracket (1A) and a lower bracket (1B) for support of other elements of the material breaking device;

an inlet tube (2) fixedly attached to the upper bracket (1A);

an outlet tube (3) fixedly attached to the lower bracket (1B);

a tubular housing (4) arranged between said brackets (1A, 1B), wherein the tubular housing (4) is attached to the inlet tube (2) for receiving particles to be milled and to the outlet tube (3) for output of milled particles, wherein the tubular housing (4) is attached to said tubes (2, 3) in a rotatable manner such that the tubular housing (4) can rotate relative to the frame structure (1);

at least one conical distributor (5) arranged in the tubular housing (4) and comprising recesses (5A) therearound allowing particles to pass along said conical distributor (5), wherein the conical distributor (5) defines a first milling chamber (6), and wherein the conical distributor (5) is fixedly attached to the tubular housing (4);

at least one outlet cone (7) arranged in the tubular housing (4) downstream from the conical distributor (5) and comprising a through hole (7A) allowing particles to pass through said outlet cone (7), wherein the outlet cone (7) defines a second milling chamber (8), and the outlet cone (7) is fixedly attached to the tubular housing (4), and wherein the first milling chamber (6) or/and the second milling chamber (8) contains milling particles made of magnetic material;

a permanent magnet unit (9) comprising a permanent magnet (10) and the permanent magnet unit (9) is attached to the tubular housing (4) such that at least two permanent magnet units (9) are provided for each milling chamber (6, 8), and wherein at each milling chamber (6; 8) two permanent magnet units (9) are positioned on the outer periphery of the tubular housing facing each other such that the permanent magnet (10) of one permanent magnet unit (9) is positioned adjacent one side of the tubular housing and another permanent magnet (10) of another permanent magnet unit (9) with the same magnetic pole is positioned adjacent an opposing side of the tubular housing and the permanent magnets (10) of each permanent magnet unit (9) are positioned so that each of these magnets (10) faces the outer wall of the tubular housing (4) with the same magnetic pole;

a drive unit for providing rotation of the tubular housing (4) relative to the frame structure (1), the inlet tube (2) and the outlet tube (3) creating rotating magnetic field within the milling chambers (6, 8).

2. The material breaking device according to claim 1, characterized in that each one of the two permanent magnet units (9) further comprises a gap adjustment means to control a distance between the permanent magnet (10) and the tubular housing (4) such that a magnetic field generated by the permanent magnet (10) can be adjusted.

3. The material breaking device according to claim 1, characterized in that the conical distributor (5) is in the shape of concave cone.

4. The material breaking device according to claim 1, characterized in that the recesses (5A) of the conical distributor (5) are arranged therearound at a base portion (5B) of the conical distributor (5).

5. The material breaking device according to claim 1, characterized in that the outlet cone (7) is in the shape of concave cone.

6. The material breaking device according to claim 1, characterized in that the through hole (7A) of the outlet cone (7) extends along the central axis of the outlet cone (7).

7. The material breaking device according to claim 1, characterized in that the conical distributor (5) and the outlet cone (7) define a pair of milling chambers (6, 8), wherein the tubular housing (4) comprises from three to six pairs of the conical distributor (5) and the outlet cone (7).

8. The material breaking device according to claim 1, characterized in that the tubular housing (4), the conical distributor (5), and the outlet cone (7) are coaxially aligned on the central axis (X) of the material breaking device.

9. A method for breaking material using the material breaking device according to claim 1, wherein the method comprises the following steps:

feeding of particles to be milled into the tubular housing (4) through the inlet tube (2);

providing rotation of the tubular housing (4) relative to the frame structure (1) in result of which a rotational magnetic field is created within the tubular housing (4), within the first milling chamber (6) and the second milling chamber (8) in the tubular housing (4) such that particles are set into a further motion against an inner wall of the tubular housing (4), the conical distributor (5) and the outlet cone (7) that facilitates breaking of said particles;

providing milling particles made of magnetic material into the first milling chamber (6) and/or the second milling chamber (8) to facilitate the milling process; and providing outlet of milled particles through the outlet tube (3).

10. The method according to claim 9, characterized in that in the step of feeding the particles a pressurized fluid is also fed into the tubular housing (4).

* * * * *